US009592896B1

(12) United States Patent
Scriven

(10) Patent No.: US 9,592,896 B1
(45) Date of Patent: Mar. 14, 2017

(54) WATERPROOF FLOATATION CASE FOR OUTBOARD MOTOR

(71) Applicant: Rick Scriven, Stafford, VA (US)

(72) Inventor: Rick Scriven, Stafford, VA (US)

( * ) Notice: Subject to any disclaimer, the term of this patent is extended or adjusted under 35 U.S.C. 154(b) by 0 days.

(21) Appl. No.: 14/957,496

(22) Filed: Dec. 2, 2015

(51) Int. Cl.

| | |
|---|---|
| ***B63H 20/32*** | (2006.01) |
| ***B63H 21/36*** | (2006.01) |
| ***B63G 8/08*** | (2006.01) |
| ***B65D 85/68*** | (2006.01) |
| *B63B 17/02* | (2006.01) |

(52) U.S. Cl.
CPC ..... *B63H 20/32* (2013.01); *B63G 8/08* (2013.01); *B65D 85/68* (2013.01); *B63H 21/36* (2013.01); *B65D 2585/6877* (2013.01)

(58) Field of Classification Search
CPC .... B63H 20/32; B63H 2020/32; B63H 21/36; B65D 85/68; B65H 2585/6877
USPC ..... 440/76; 114/361
See application file for complete search history.

(56) References Cited

U.S. PATENT DOCUMENTS

| | | | | |
|---|---|---|---|---|
| 2,434,784 A * | 1/1948 | Bardin | B63H 20/36 | 150/157 |
| 2,475,135 A * | 7/1949 | Haven | B63H 20/36 | 150/157 |
| 3,587,508 A * | 6/1971 | Pearce | B63H 20/36 | 150/166 |
| 3,870,875 A * | 3/1975 | Altimus | B60Q 1/30 | 150/157 |
| 5,072,683 A * | 12/1991 | Colonna | B63H 20/36 | 114/222 |
| 5,660,136 A * | 8/1997 | Pignatelli | B63H 20/36 | 114/361 |
| 5,813,361 A * | 9/1998 | Milliman | B63J 2/12 | 114/361 |
| 8,656,967 B2 * | 2/2014 | Switzer | B65D 85/68 | 150/157 |

* cited by examiner

*Primary Examiner* — Daniel V Venne
(74) *Attorney, Agent, or Firm* — Richard K Thomson

(57) ABSTRACT

A waterproof floatation case is provided for an outboard motor which is suitable for use during deployment for covert operations with an inflatable motor craft. The encased propulsion unit can be mounted without the need for removing the case and the two panels of the case butterflied between the motor and watercraft to permit full operation of the motor. A 2-way valve permits suction to be drawn down on the case evacuating excess air and corrosive fluids from the encased motor.

10 Claims, 4 Drawing Sheets

WATERPROOF FLOATATION CASE FOR OUTBOARD MOTOR

BACKGROUND AND SUMMARY OF THE INVENTION

The present invention is directed to the field of marine propulsion. More particularly, the present invention is directed to a protective waterproof floatation case for a marine propulsion unit such as an outboard motor deployed from a submarine, or the like, enabling the motor to float without shooting to the surface like a cork, endangering any personnel in the vicinity or monitoring its deployment. It is a further advantage of the waterproof case of the present invention that this case enables the motor to be suspended from the transom and operated without the need to completely remove the case. Lastly, two-way valves allow the case to evacuated of corrosive fluids such as residual fuel and vapors which could otherwise destroy plastic parts of the motor disabling the propulsion unit.

In covert military operations, and the like, personnel are deployed from a submarine with an inflatable raft and an outboard motor which is attached/attachable to the raft. The motor must be small enough to be ejected from a through-port such as a torpedo bay. The 30 HP Evinrude multi-fuel engine has proven suitable for this application. To protect the outboard motor, the engine needs to be encased in a waterproof case.

Problems with existing encasements include lack of durability. Existing systems are easily torn exposing the engine to ingestion of water (probably saline) which can lead to inoperability of the motor and exposing the military personnel to danger topside on an immobile floating platform. Further problems with existing cases include subsequent storage. Residual fuel in the engine leaks into the compartment formed by the case and is corrosive to plastic parts in the engine resulting in an inoperative motor which is, accordingly, useful only as a paperweight.

A second set of problems associated with existing cases has to deal with their size. Since, generally, the cases are not tailored to fit a particular motor, they are significantly larger than they need to be. Even when cases have been made with particular motors in mind, they typically are not snugged up around the motor. These oversized cases may prevent the package from fitting through the limited-sized space available such that the motor cannot be deployed at all from the through-port or frequently gets stuck requiring excessive effort to eject it from the vessel.

In addition, these oversized cases entrap a great deal of air such that the package is not easily made neutrally buoyant, requiring in excess of 400 lbs. in weights to be added. These rapidly rising packages shoot like corks dozens of feet into the air. Such a projectile imposes a hazard to the personnel deployed with the raft and the impact upon returning to the surface of the water may damage the package, either the casing or the motor itself. The rapidly rising package can present a problem for the deployed personnel to keep up with. If they succeed in rising at the same rate as the engine, they may experience an arterial gas embolism (AGE).

Lastly, and perhaps most importantly, once the encased motor reaches the surface, the bag must be removed from the motor to enable it to be mounted on the transom of the inflatable raft. These covert operations are typically performed in the dead of night and removing the case and mounting the motor is problematic in calm seas and, should the weather refuse to cooperate, the military personnel tasked with the problem frequently lose their grip and the unclad motor plunges into the water threatening to disable the engine. It is among the features of the present invention to permit the motor to be mounted on the transom securely and the case taken out of the way without requiring total removal, thereby allowing the team to get underway in a significantly shorter time than is possible with existing cases. This can be critical, not only to the success of the mission but to the survival of the military personnel, given that while attempting to deploy the watercraft, the team is essentially a flock of sitting ducks.

It is among the objects of the present invention to overcome the problems associated with the prior art cases. The waterproof case of the present invention is tailor-made for the 30 HP Evinrude multi-fuel engine (MFE), the motor which is frequently deployed in these covert military operations. It will be appreciated that the features of the present invention could be configured to house a different engine without departing from the particulars of the invention. This vulcanized skin-tight case has a plurality of valves, several one-way "exhaling" valves which permit air to be expelled from the interior but no air (or water) allowed in. A separate two-way valve is provided which will allow re-inflation once the package has reached the surface. The case of the present invention increases the dimensions of the engine cover by no more than ½" in any direction. The volume of the case housing the motor is reduced by more than 50% from 14 $ft^3$ to 6.9 $ft^3$. This slim package can more easily be guided through the 30" diameter torpedo bay than prior art encased motors. Further, the waterproof case of the present invention is neutrally buoyant to 50 FSW (feet of sea water). To make one of the prior art cases neutrally buoyant to 50 FSW would require over 400 lbs of lead weight. That compares to roughly 120 lbs with the bag of the present invention.

The material used in constructing this case is a nylon mesh fabric coated with a Neoprene® elastomer to create a fabric having a weight of 60 oz per square yard. This fabric has a breaking strength of 1000 psi. The vulcanization process used for glue-free assembly has had no history of delamination in the over 30 years since its development. Additional reinforcement is provided in areas where additional strength is needed, i.e., where the unit is attached to the transom (which can be effected prior to deployment, if desired), and in the areas of the propeller and gear box. This reinforcement is preferably supplied by doubling the thickness of the skin in those areas of concern.

The present invention consists of a waterproof floatation case for an outboard motor including a) a left side panel constructed of waterproof material and having a first edge; b) a right side panel constructed of waterproof material and having a first edge, said first edge of the right side panel being common to the first edge of the left side panel; c) a waterproof zipper extending at least 180° about a peripheral extent a second edge of the left side panel and a second edge of the right side panel of the waterproof floatation case, the peripheral extent including the first and second common edges; whereby an outboard motor fully encased in said waterproof floatation case may be discharged from a submarine, mounted on a transom of an inflatable watercraft, the waterproof zipper moved to a disengaged position and the left side butterflied with a bungee and the right side butterflied with a second bungee allowing the outboard motor to be operated without having the waterproof floatation case fully removed from the outboard motor.

Preferably, the waterproof material from which the left panel and the right panel are constructed is nylon mesh fabric to which an elastomer is secured. More preferably, the elastomer comprises a neoprene secured to the nylon mesh fabric by vulcanization. The case preferably includes at least a single one-way valve permitting the waterproof floatation case to off-gas excessive atmospheric pressure when exposed to subsurface conditions. More preferably, the at least a single one-way valve comprises a plurality of one-way valves. In addition, a two-way valve is positioned atop the waterproof floatation case permitting influx and efflux of air to and from the waterproof floatation case. Further, reinforcement means is situated within the waterproof floatation case in areas of concern for potential puncture, those regions including the area where the outboard motor attaches to a transom of the watercraft, adjacent a gear box of the motor and in a vicinity of a prop.

A second aspect of the present invention is directed to a method of deploying a watercraft for covert military operations, and the like, comprising the steps of a) encasing a propulsion unit in a waterproof case, the waterproof case having a zipper which extends at least 180° about a vertical periphery of the case; b) deploying the watercraft from a subsurface vessel, the watercraft including an inflatable raft and the encased propulsion unit; c) mounting the encased propulsion unit on a transom of the inflated raft; d) disengaging the zipper to partially reveal the propulsion unit; e) butterflying a left panel of the waterproof case on a first side of the propulsion unit and securing the left panel of the butterflied case in a first position enabling operation of the propulsion unit; f) butterflying a right panel of the waterproof case on a second side of the propulsion unit and securing the right panel of the butterflied case in a second position enabling operation of the propulsion unit without the necessity of completely removing the waterproof case.

Yet a third aspect of the present invention involves a method of encasing a propulsion unit of a watercraft following a covert military operation comprising the steps of a) releasing a first bungee securing a right panel of a waterproof case from its position secured adjacent a right side of the propulsion unit; b) releasing a second bungee securing a left panel of a waterproof case from its position secured adjacent a left side of the propulsion unit; c) reconfiguring the waterproof case to surround the propulsion unit; d) re-engaging a waterproof zipper which extends at least 180° about a vertically oriented periphery of the propulsion unit, a first half of which zipper extends along a first edge of the right panel and a second half of which zipper extends along a first edge of the left panel to form a waterproof enclosure for the propulsion unit; e) pulling suction on the waterproof enclosure to evacuate corrosive fluids from an interior portion of the enclosure prior to storing the encased propulsion unit.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
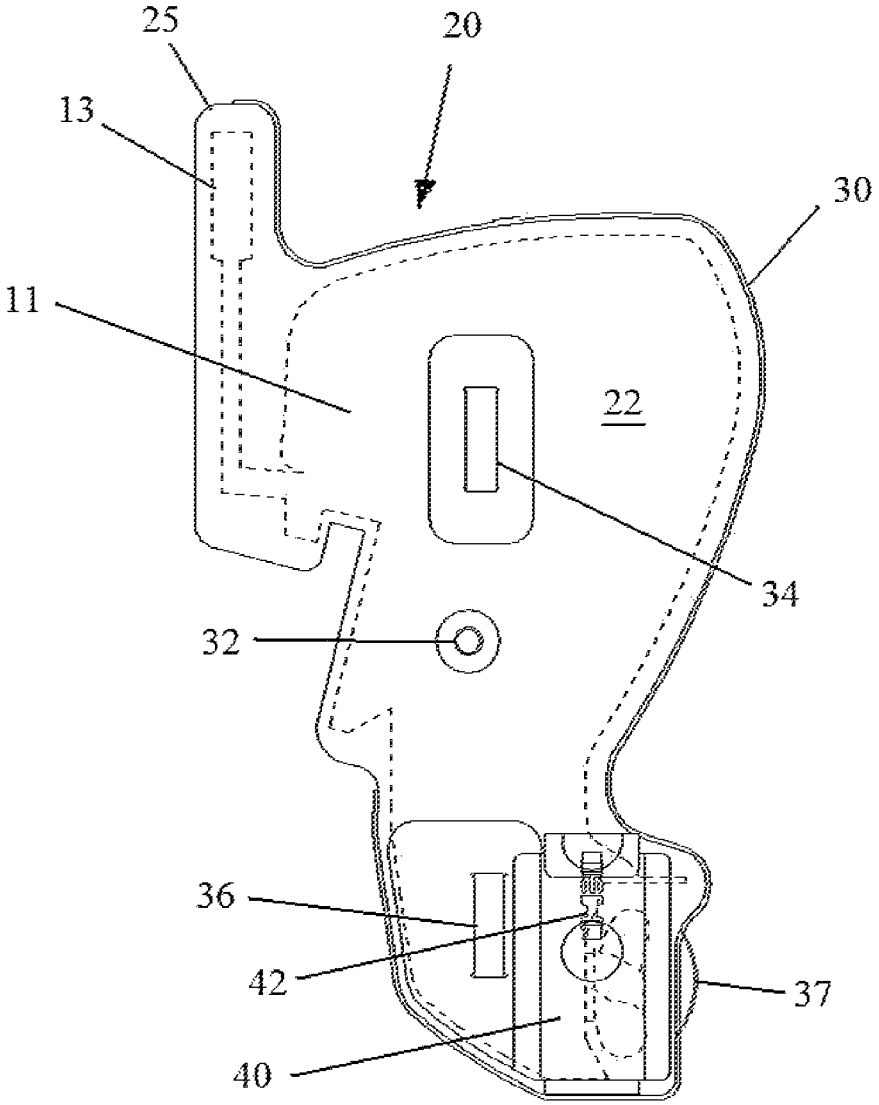
FIG. 1 is a side view of the left side of a first embodiment of the outboard motor case of the present invention showing the position of the motor in dotted line.
Figure 2:
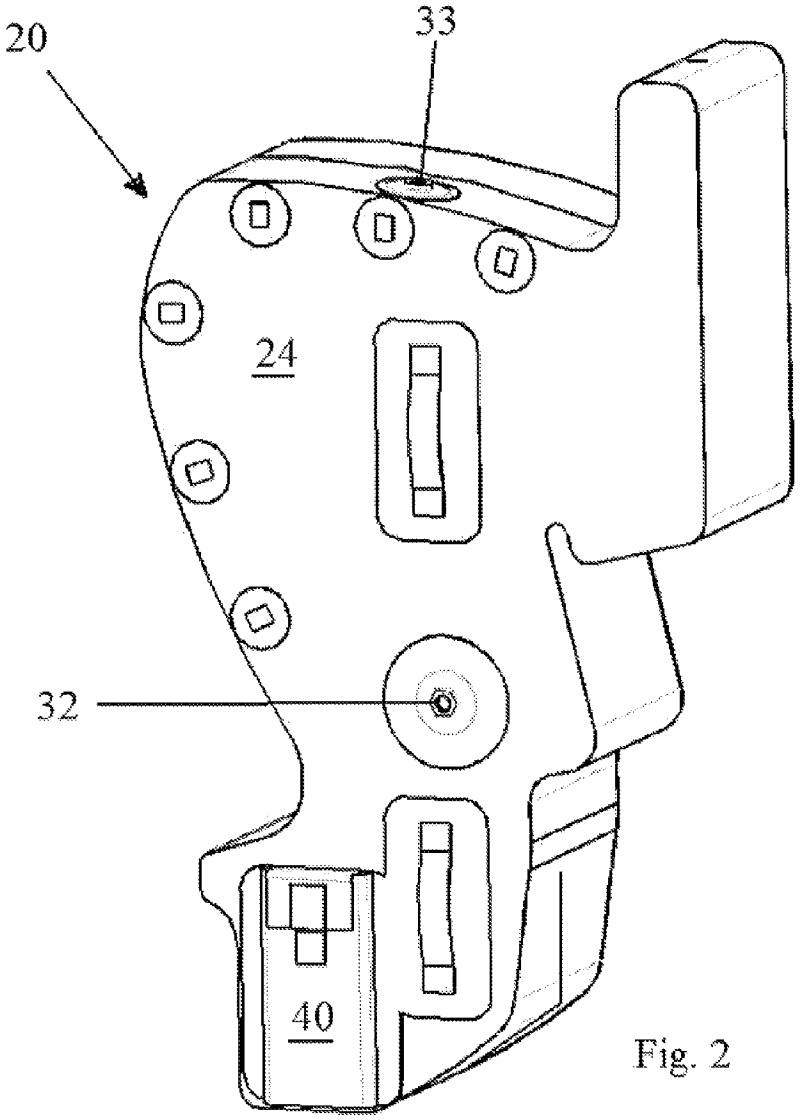
FIG. 2 is a right side perspective view of the first embodiment.
Figure 3:
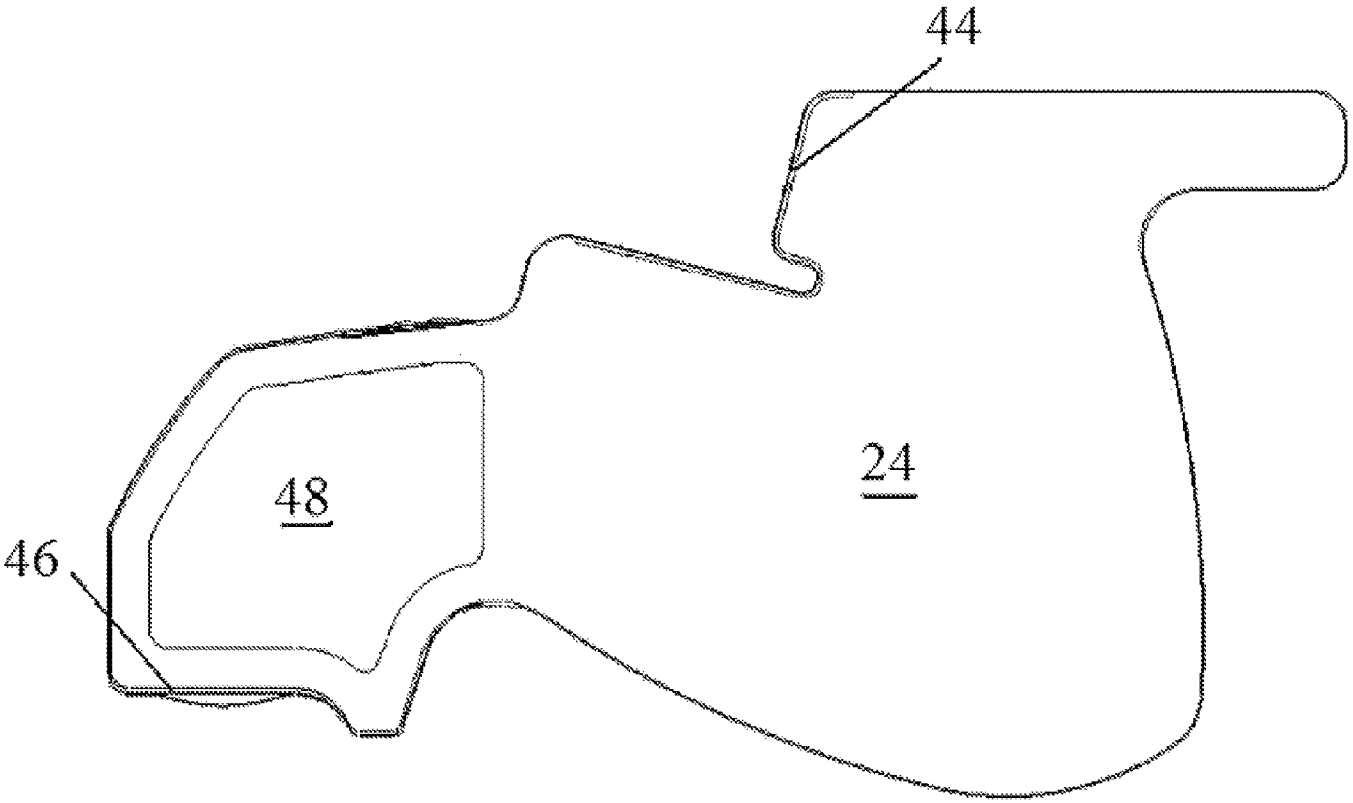
FIG. 3 is a front view of the inside of the right panel of the first embodiment.
Figure 4A:
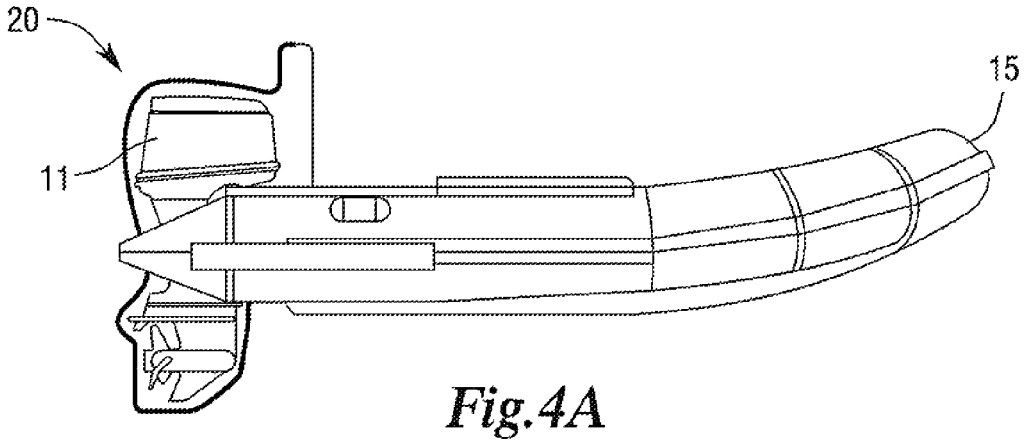
FIG. 4A is a side view of the first embodiment deployed on a watercraft; and, FIG. 4B is a schematic rear view of the first embodiment deployed on a watercraft.
Figure 4B:
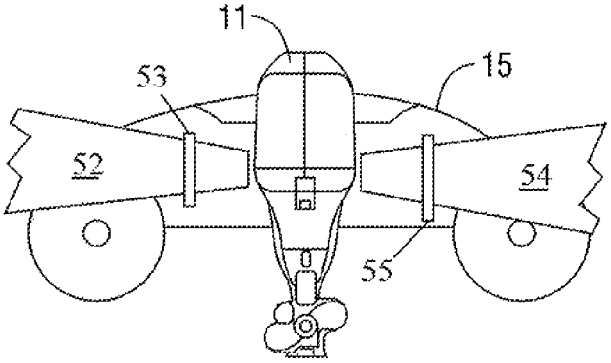

A first embodiment of the waterproof case of the present invention is depicted in FIGS. 1-2 generally at 20. Case 20 includes a left panel 22 and right panel 24 interconnected by common first edges 26 (FIG. 3). Waterproof case 20 is preferably made of a woven nylon mesh fabric with neoprene vulcanized to its surface to form a 60 oz per square yard waterproof fabric. Case 20 is tailor-made to receive a 30 HP Evinrude multi-fuel engine 11. The shape of the case provides an arm 25 which accommodates the throttle lever 13. The sides of case 20 are extremely flexible and the interior of the case can be evacuated crinkling the case 20 to adhere closely to the outline of the engine/motor 11. This allows excess air pressure to be removed and reduces the amount of added weight needed (from 400 lbs to 120 lbs) to make the case 20 neutrally buoyant at from 33-50 feet of seawater (FSW). Obviously, the lighter weight encased motor will be easier to manipulate both before and after deployment onto/off of the motorcraft 15 (FIG. 4A, 4B). Pockets 40 with latches 42 are provided on either side of case 20 to accommodate lead weights (not shown) to achieve the neutral buoyancy desired for the depth from which the encased motor 11 will be deployed.

A waterproof zipper 30 extends along at least 180° of the lateral peripheral extent of a second edge of case 20 and more preferably, over 240° of the lateral peripheral extent. Two one-way valves 32, one on either side, are provided which allow air trapped inside case 20 to vent to atmosphere. These valves 32 can be chosen to vent at whatever psi desired. A two-way valve 33 is positioned along the top surface of case 20 and permits air to be input or exhausted, as desired. Vacuum can be pulled on valve 33 to eliminate extra trapped air which would cause case 20 to pop to the surface like a cork. By eliminating approximately ½ the extra air within the case 20 and inserting 120 lbs of lead weights in pockets 40, the case 20 with its 30 HP Evinrude engine cargo can be made neutrally buoyant to 50 FSW. In addition, following restoration of the encased motor 11 when deployment has been completed, the two-way valve 33 permits evacuation of corrosive fluids including fuel and fumes which would otherwise harm the plastic parts of motor 11.

Two pair of two inch wide handles 34 and 36 are sewn to each side and a fifth handle 37 is provided along the edge (FIG. 1). These handles 34, 36, and 37 facilitate a three-man carry in which handles 34 are grasped on either side of case 20 and the third soldier grabs handle 37 to effectively steer the lower or tail end of motor 11. A 3-man carry is effected when loading and unloading the encased propulsion unit 11 from its deployment vessel (typically, a submarine). The 6 opposing pairs of eyelets on panels 22, 24 from which carabiner clips 25 (FIG. 2) can be attached permitting suspension of the encased motor 11 during storage.

In operation, the watercraft 15 and encased propulsion unit 11 will be deployed from the submarine, typically through a torpedo bay. Some deployment vessels are equipped with special rooms permitting the propulsion unit 11 to be pre-mounted on the transom of the watercraft and deployed as a package. Generally, however, the military personnel being deployed on the covert ops will keep track of the watercraft 15 by means of a tether and accompany the propulsion unit 11 on its ascent to the surface. The motor 11 will be mounted on the transom of the watercraft 15 while it is still fully encased in waterproof case 20. Zipper 30 will be fully opened and the left panel 52 is "butterflied" (i.e., bunched or gathered into a mass resembling a butterfly wing), then retained in that shape using a bungee 53. Similarly, the right panel 54 is butterflied and retained using a second bungee 55. The motor 11 is now fully operational and the watercraft 15 mission-ready without having to remove the case 20 from the motor 11. This cuts deployment time in half greatly reducing the risk of life and limb to the deployed unit and eliminating the risk of dropping the non-encased motor 11 into the brink while attempting to mount it on the transom, as was formerly the case.

When the mission is complete, bungees 53, 55 release the butterflied panels 52, 54 and the case 20 wrapped about propulsion unit 11 and zipper 30 closed to fully encase outboard motor 11. Vacuum can be pulled on two-way valve 33 to remove any excess air and pollutants such as unburned fuel and fumes which could potentially corrode particularly the plastic parts of the motor 11.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A waterproof floatation case for an outboard motor, said case comprising:

a) a left side panel constructed of waterproof material and having a first edge;

b) a right side panel constructed of waterproof material and having a first edge, said first edge of said right side panel being common to said first edge of said left side panel;

c) a waterproof zipper extending at least 180° about a peripheral extent a second edge of said left side panel and a second edge of said right side panel of said waterproof floatation case, said peripheral extent including said first and said second common edges;

whereby an outboard motor fully encased in said waterproof floatation case may be discharged from a submarine, mounted on a transom of an inflatable watercraft, said waterproof zipper moved to a disengaged position and said left side butterflied with a bungee and said right side butterflied with a second bungee allowing the outboard motor to be operated without having said waterproof floatation case fully removed from said outboard motor.

2. The waterproof floatation case of claim 1 wherein said waterproof material from which said left panel and said right panel are constructed is nylon mesh fabric to which an elastomer is secured.

3. The waterproof floatation case of claim 2 wherein said elastomer comprises a neoprene secured to said nylon mesh fabric by vulcanization.

4. The waterproof floatation case of claim 1 further comprising at least a single one-way valve permitting said waterproof floatation case to off-gas excessive atmospheric pressure when exposed to subsurface conditions.

5. The waterproof floatation case of claim 4 wherein said at least a single one-way valve comprises a plurality of one-way valves.

6. The waterproof floatation case of claim 4 further comprising a two-way valve positioned atop said waterproof floatation case permitting influx and efflux of air to and from said waterproof floatation case.

7. The waterproof floatation case of claim 1 further comprising reinforcement means situated within said waterproof floatation case in areas of concern for potential puncture.

8. The waterproof floatation case of claim 7 wherein said areas of concern include where the outboard motor attaches to a transom of the watercraft, adjacent a gear box of the motor and in a vicinity of a prop.

9. A method of deploying a watercraft for covert military operations, and the like, comprising the steps of a) encasing a propulsion unit in a waterproof floatation case, the waterproof floatation case having a zipper which extends at least 180° about a vertical periphery of the case;

b) deploying the watercraft from a subsurface vessel, said watercraft including an inflatable raft and the encased propulsion unit;

c) mounting the encased propulsion unit on a transom of the inflated raft;

d) disengaging the zipper to partially reveal the propulsion unit;

e) butterflying a left panel of the waterproof case on a first side of the propulsion unit and securing the left panel of the butterflied case in a first position enabling operation of the propulsion unit;

f) butterflying a right panel of the waterproof case on a second side of the propulsion unit and securing the right panel of the butterflied case in a second position enabling operation of the propulsion unit without the necessity of completely removing the waterproof case.

10. A method of encasing a propulsion unit of a watercraft following a covert military operation comprising the steps of a) releasing a first bungee securing a right panel of a waterproof floatation case from its position secured adjacent a right side of the propulsion unit;

b) releasing a second bungee securing a left panel of the waterproof floatation case from its position secured adjacent a left side of the propulsion unit;

c) reconfiguring the waterproof floatation case to surround the propulsion unit;

d) re-engaging a waterproof zipper which extends at least 180° about a vertically oriented periphery of the propulsion unit, a first half of which zipper extends along a first edge of the right panel and a second half of which zipper extends along a first edge of the left panel to form a waterproof enclosure for the propulsion unit;

e) pulling suction on the waterproof enclosure to evacuate corrosive fluids from an interior portion of the enclosure prior to storing the encased propulsion unit.

* * * * *